United States Patent [19]

Meryash

[11] Patent Number: 4,457,025

[45] Date of Patent: Jul. 3, 1984

[54] DROP-SEAT JUMP SUIT

[76] Inventor: Harriette E. Meryash, 35 Curtis St., Marblehead, Mass. 01945

[21] Appl. No.: 543,153

[22] Filed: Oct. 18, 1983

[51] Int. Cl.[3] ..... A41D 1/06

[52] U.S. Cl. ..... 2/79

[58] Field of Search ..... 2/79, 80, 78 A, 78 B, 2/78 R

[56] References Cited

U.S. PATENT DOCUMENTS

| | | | |
|---|---|---|---|
| 3,088,116 | 5/1963 | Simonoff | 2/79 |
| 3,852,824 | 12/1974 | Grey | 2/79 |
| 3,994,026 | 11/1976 | Sampey | 2/79 |

*Primary Examiner*—Doris L. Troutman

*Attorney, Agent, or Firm*—Thomas C. Stover, Jr.

[57] ABSTRACT

An improved jump suit with a rear drop-seat panel that opens downwardly is provided. The suit has a flexible panel mounted across the inside front portion thereof to define pockets therewith. The panel further extends on either side of the suit to define tapered flaps which overlap around the rear portion of the suit near the waist and under the drop-seat panel when it is raised to the closed position.

The overlapped flaps are joined by attaching means such as VELCRO and the drop-seat panel has attaching means thereon such as VELCRO or zippers which engage matching fasteners on proximate portions of the flaps when the panel is closed over the flaps.

The overlapped flaps supplement the strength of the jump suit and enhance the fit thereof and reduce draftiness at the seams of the drop-seat panel.

13 Claims, 4 Drawing Figures

DROP-SEAT JUMP SUIT

BACKGROUND OF THE INVENTION

1. Field of the Invention

This invention relates to an improved jumpsuit, particularly a jumpsuit having a drop seat.

2. The Prior Art

Numerous jumpsuit designs have appeared for work and leisure applications. Various designs of jumpsuits have been developed and patented. Several jumpsuits with drop seats have been proposed. See for example U.S. Pat. No. 1,537,230 to Godbehere (1925), U.S. Pat. No. 3,956,774 to Spaulding (1976) and U.S. Pat. No. 3,994,026 to Sampey (1976).

The above three references disclose jumpsuits with drop seats but all lack reinforcement at the rear portion of the jumpsuit where the seat is dropped. That is, no underpanels supplement the strength of the garment and enhance the fit thereof when the seat panel is raised and particularly when it is dropped and there is a need and market for an improved jumpsuit with drop seat that substantially overcomes the above prior art shortcomings.

There has now been developed a jumpsuit with drop seat in which underflaps overlap inside the drop seat flap to enhance the fit of the jumpsuit and to reinforce the jumpsuit in this area with the drop seat panel up or down and also prevent the suit from being "drafty" or open at the panel edges when the drop seat panel is raised in the closed position.

SUMMARY OF THE INVENTION

Broadly, the present invention provides an improved jumpsuit comprising a jumpsuit having a body, neck opening, arm sleeves, leg sleeves and a rear drop seat panel that pivots downwardly, said suit having a pair of spaced flaps mounted to said suit at the sides thereof, which flaps overlap around the rear portion of said suit and inside the drop seat panel when it is brought to the closed position.

In another embodiment, a panel mounts to the inside front portion of the jumpsuit near or below the waist thereof to define pockets between such panel and the front of the jumpsuit, which panel terminates in the above flaps, which overlap at the rear portion of the jumpsuit.

BRIEF DESCRIPTION OF THE DRAWINGS

The invention will become more apparent from the following detailed, specification and drawings in which.

DESCRIPTION OF PREFERRED EMBODIMENT

Figure 1:
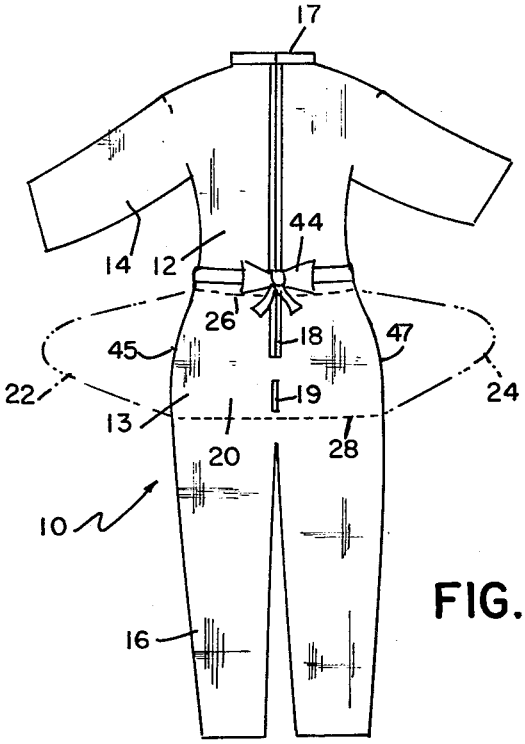
FIG. 1 is a front elevation view of the jumpsuit with drop seat embodying the present invention.
Figure 2:
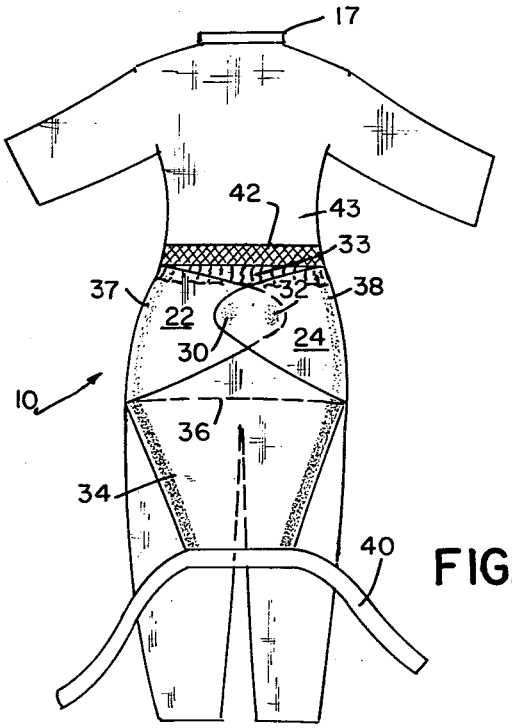
FIG. 2 is a rear elevation view of the jumpsuit embodiment shown in FIG. 1 with the seat dropped.
Figure 4:
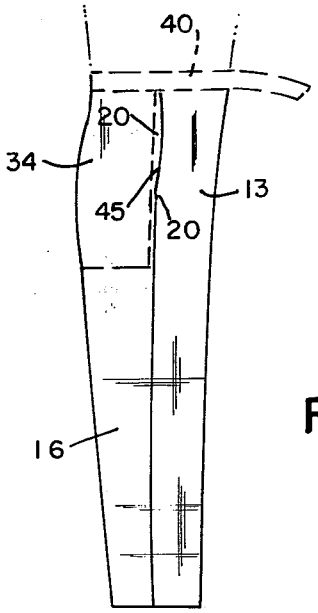
FIG. 4 is a fragmentary side elevation view of the jumpsuit embodiment shown in FIG. 1.

Referring to the invention in more detail, jumpsuit 10 has body 12, arms 14, legs 16, neck opening 17 and zipper 18, as shown in FIG. 1. The jumpsuit further has an innerpanel 20 with wing flaps 22 and 24, which panel 20 is attached to the front portions of the jumpsuit at seams 26 and 28, as shown in FIG. 1. The flaps 22 and 24 fold around the hind quarter of the wearer (not shown) and attach by fasteners e.g. by VELCRO portions 30 and 32, as shown in FIG. 2. The flap panel 34 which bends downwardly on fold 36 (for toilet purposes) as shown in FIG. 2, folds upwardly to the closed position and engages VELCRO strips 37 and 38 as shown in FIG. 2 and the belt 40 thereof is wrapped around the elasticized waistband 42 of the garment and tied in front e.g. as bow 44 as shown or indicated in FIGS. 4 and 1.

Figure 3:
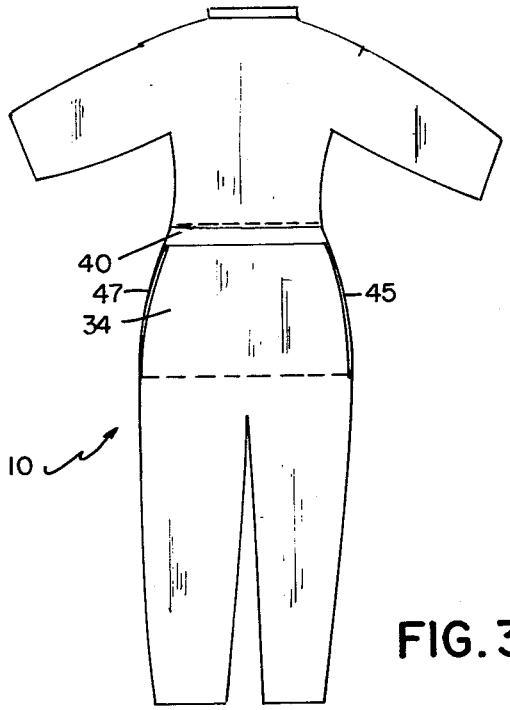
FIG. 3 is a rear elevation of the jumpsuit embodiment of FIG. 1 with the seat raised.

The innerpanel 20, together with the outer body portion 13, forms a double-layered portion that defines a pocket 45 across the front of the suit or a pair of pockets 45 and 47 divided by zipper 18 and seam 19, as shown or indicated in FIGS. 1 and 3.

A further view of the jumpsuit with seat or flap 34 in a closed (invisible) position is shown in a rear view of the jumpsuit in FIG. 3.

Accordingly, the jumpsuit with drop seat embodying the invention, has an inner front panel, which reinforces the suit and provides pockets in the garment, which panel further has a pair of flaps which wrap around the wearer in the back, overlap and fasten to reinforce the jumpsuit even with the drop seat panel opened and further provide an added seal or closure and prevent a draft at the panel edges when the drop seat panel is raised to the closed position.

Advantageously, the underflaps are tapered toward their overlapping ends as indicated in FIG. 2 so that with the drop seat panel open, the flaps may remain in the overlap position without interfering with the toilet activities of the wearer. However, if desired the flaps can be opened at this time.

The underflaps have the further advantage of having an adjustable overlap so as to be pulled in as close a fit as desired around the hips of the wearer for comfort and custom fit purposes. As stated above, the flaps provide an effective seal when the drop seat panel is fastened in the closed position. Desirably such panel is co-extensive with the width of the jumpsuit, e.g. from side seam to seam, so that the drop seat is practically invisible as indicated in FIG. 2. Of course such panel can be of greater or lesser relative width as desired within the scope of the invention.

Accordingly, the winged panel- drop panel combination, is believed a novel improvement to jumpsuit design.

The underflaps can be attached to the body of the jumpsuit at the side seams or other points or can be part of a winged panel attached to the body of the jumpsuit e.g. as discussed above, as an inside winged panel or similarly mounted outside winged panel (not shown), which outside panel can have openings therein for access to the pocket or pockets defined by such panel and the body of the garment.

The flap shape can be angular, rounded or a combination thereof. Preferably such flaps taper toward the ends thereof so that they may remain in overlapped, closed position even when the seat panel is dropped.

The flaps may fasten together without overlapping e.g. by buttons, VELCRO, lacing and the like. Preferably, however, the underflaps overlap and fasten together by any suitable means e.g. buttons, snaps, hooks and preferably by VELCRO means, e.g. patches or strips. The drop panel similarly attaches to the surfaces of the overlapped underflaps by the means described above, e.g. by VELCRO and preferably by zippers including plastic zippers. Further, the drop seat panel can have a belt, cord or other wrapping means attached thereto which wraps around the waist of the wearer, but this can be dispensed with, if desired. Alternatively, such belt or wrap can be employed in place of fastening means between the drop panel and the underflaps if desired. Preferably, however, both types of fastening means, i.e. between underflaps and around the waist of the garment are used for failsafe closure.

Where a front pocket panel is part of the garment, either within or without the body thereof, it can be a continuous pocket open at both ends or can be divided into two compartments as indicated above, by a zipper or seam or combination thereof.

The front of the jumpsuit embodying the invention can have various front fasteners e.g. zipper means, buttons, snaps, VELCRO or other closure means as desired within the scope of the invention.

The flaps are mounted on the jumpsuit near the waist thereof including at the waist or at least partly above the waist or partly below and preferably below the waist.

An extension of the back portion 43 of the jumpsuit 10 extends through the elasticized band 42 as a pleated or multifold flap 33 which fits under the overlapped flaps 22 and 24, as shown in FIG. 2. The flap 33 further covers the wearer and reduces drafts above the overlapped flaps 22 and 24 as indicated in FIG. 2. The flap 33 is preferred but may be omitted as desired.

By "VELCRO", as used herein is meant a patch of tiny flexible hooks which releasably engage a fiber patch.

The jumpsuit with drop seat of the invention is intended for outdoor wear as well as indoor wear and can be made of various suitable materials e.g. quilted materials, cotton or wool, denim, silk or other materials and further, can be employed as a running or jogging suit.

What is claimed is:

1. A jumpsuit having a body, a pair of arm sleeves, a pair of leg sleeves, and a rear drop seat panel that pivots from the suit body, said suit having a pair of spaced flaps attached to the body of said suit proximate the waist thereof, which flaps overlap around the rear portion of said suit near the waist and inside said drop seat panel when raised to the closed position.

2. The jumpsuit of claim 1 wherein said flaps when overlapped are joined by attaching means mounted on the overlapping portions thereof.

3. The jumpsuit of claim 2 wherein said flaps taper near the end thereof.

4. The jumpsuit of claim 1 wherein a flexible panel is mounted across the inside front portion of said suit to define pockets therewith, which panel extends on either side of said suit to define said flaps.

5. The jumpsuit of claim 4 wherein said flaps taper to the overlapping portions thereof.

6. The jumpsuit of claim 5 wherein said drop seat panel has fastening means thereon to engage portions of said suit when raised to the closed position.

7. The jumpsuit of claim 6 wherein said fastening means are zippers.

8. The jumpsuit of claim 6 wherein said drop seat panel has VELCRO fasteners attached thereto which engage matching VELCRO fasteners on proximate portions of said flaps when said panel is closed over said flaps.

9. The jumpsuit of claim 8 wherein said drop seat panel has a belt mounted thereon which wraps around the waist of the jumpsuit when said panel is raised to the closed position.

10. The jumpsuit of claim 1 being openable at the front from the top of said body portion at least to the proximity of the waist portion and being openable and closeable by fastening means.

11. The jumpsuit of claim 2 wherein said fastening means are VELCRO, buttons, hooks or zippers.

12. The jumpsuit of claim 6 wherein said drop seat panel extends across the body of said jumpsuit from one side to the other so as to present no additional side seams when said drop seat panel is raised to the closed position.

13. The jumpsuit of claim 3 where a waist flap extends from the back portion of said jumpsuit, below the waist and under said overlapped flaps.

* * * * *